US009506661B2

(12) United States Patent
Yamada et al.

(10) Patent No.: US 9,506,661 B2
(45) **Date of Patent: *Nov. 29, 2016**

(54) DUCT TYPE AIR CONDITIONER

(75) Inventors: Futoshi Yamada, Kawasaki (JP); Katsuya Kato, Kawasaki (JP)

(73) Assignee: Fujitsu General Limited, Kawasaki-shi (JP)

( * ) Notice: Subject to any disclaimer, the term of this patent is extended or adjusted under 35 U.S.C. 154(b) by 525 days.

This patent is subject to a terminal disclaimer.

(21) Appl. No.: 12/902,187

(22) Filed: Oct. 12, 2010

(65) Prior Publication Data

US 2011/0138844 A1 Jun. 16, 2011

(30) Foreign Application Priority Data

Dec. 11, 2009 (JP) ..... 2009-281457

(51) Int. Cl.

| | |
|---|---|
| ***F25D 17/06*** | (2006.01) |
| ***F25D 23/12*** | (2006.01) |
| ***F28F 13/12*** | (2006.01) |
| ***F01D 1/24*** | (2006.01) |
| ***F01D 3/02*** | (2006.01) |
| ***F25D 19/00*** | (2006.01) |

(Continued)

(52) U.S. Cl.

CPC ..... *F24F 1/0007* (2013.01); *F24F 13/20* (2013.01); *F24F 1/0033* (2013.01); *F24F 2013/205* (2013.01)

(58) Field of Classification Search

CPC ..... F24F 2013/20; F24F 1/0033
USPC ..... 62/259.1, 263, 298, 302; 165/127; 415/101, 102, 60–61, 213.1
See application file for complete search history.

(56) References Cited

U.S. PATENT DOCUMENTS 4,130,376 A * 12/1978 Dietsche ..... 415/213.1
4,449,376 A * 5/1984 Draper et al. ..... 62/259.1

(Continued)

FOREIGN PATENT DOCUMENTS

CN 1847735 A 10/2006
JP 62299637 A * 12/1987

(Continued)

OTHER PUBLICATIONS

Jim Bryan, Reversing the Direction of Rotation on TEFC Motors, US Motors / Emerson Motor Technologies, Product Service Bulletin, vol. 12 (Jan. 2004).*

(Continued)

*Primary Examiner* — M. Alexandra Elve
*Assistant Examiner* — Paul Alvare
(74) *Attorney, Agent, or Firm* — Locke Lord LLP

(57) ABSTRACT

A fan mechanism includes fan units having fan panels, motors mounted inwardly of said fan panels, fans positioned inwardly of the fan panels and driven by the motors, where a pair of vertical rails is mounted on both sides of each of discharge openings inwardly of the front plate so that the inner portions thereof face each other, panel retainers are attached inwardly to the lower portions of the discharge openings, press portions are formed at upper portions of both sides of the fan panels, both sides of each fan panel are pushed down into the vertical rails downward from above while being guided by the pair of vertical rails, the lower edge of the fan panel rides on the panel retainer, and the press portions are pushed down into the vertical rails, so that the fan panel is pressed against the inside of the front plate.

10 Claims, 7 Drawing Sheets

(51) Int. Cl.

| | |
|---|---|
| ***F25D 23/00*** | (2006.01) |
| ***F24F 1/00*** | (2011.01) |
| ***F24F 13/20*** | (2006.01) |

(56) References Cited

U.S. PATENT DOCUMENTS

| | | | | |
|---|---|---|---|---|
| 6,082,131 | A * | 7/2000 | Hirosawa et al. | 62/448 |
| 6,997,005 | B2 * | 2/2006 | Haasis | 62/258 |
| 8,096,137 | B2 * | 1/2012 | Czerwonky et al. | 62/259.1 |
| 2005/0198987 | A1 | 9/2005 | Haasis | |
| 2007/0237634 | A1 * | 10/2007 | Liptak | 415/213.1 |

FOREIGN PATENT DOCUMENTS

| | | | | |
|---|---|---|---|---|
| JP | S63-075717 | U | | 5/1988 |
| JP | 04006341 | A | * | 1/1992 |
| JP | 2001227768 | A | * | 8/2001 |
| JP | 2001227770 | A | * | 8/2001 |
| JP | 2007-056681 | A | | 3/2007 |
| JP | 2008075928 | A | * | 4/2008 |
| KR | 2000033827 | A | * | 6/2000 |
| KR | 2005064963 | A | * | 6/2005 |
| KR | 2009115278 | A | * | 11/2009 |
| WO | WO 2006080793 | A2 | * | 8/2006 |

OTHER PUBLICATIONS

Chinese Office Action dated Jan. 14, 2014 for corresponding Chinese Patent Application No. 201010265954.7.

Japanese Office Action mailed Jan. 10, 2014 for corresponding Japanese Patent Application No. 2009-281457.

* cited by examiner

DUCT TYPE AIR CONDITIONER

CROSS REFERENCE TO RELATED APPLICATIONS

This application is related to two co-pending applications: "DUCT TYPE AIR CONDITIONER" filed even date herewith in the name of Yusuke Hayashi claiming the right of priority under 35 U.S.C. §119 based on Japanese Patent Application No. 2009-281458; and "DUCT TYPE AIR CONDITIONER" filed even date herewith in the name of Yusuke Hayashi claiming the right of priority under 35 U.S.C. §119 based on Japanese Patent Application No. 2009-281456; which applications are assigned to the assignee of the present application and all three incorporated by reference herein.

BACKGROUND OF THE INVENTION

1. Field of the Invention

The present invention relates to a duct type air conditioner of which an improvement of a fan mechanism is intended.

2. Description of the Prior Art

As for a duct type air conditioner in the prior art, there is a technique to form a fan mechanism by assembling fans and motors with a fan panel, and the entire fan mechanism is received in a casing by mounting the fan panel inwardly of a front plate of a casing. Further, horizontal rails are provided on the upper and lower sides in the casing and said fan mechanism is withdrawn along the rails toward the left or right sides of the casing, so that maintenance is easily performed.

When, however, the duct type air conditioner is installed in a building, ducts for distributing discharged drafts needed to be provided around the casing. In such a case, there used to be a case where it is difficult to withdraw the fan mechanism in a horizontal direction in some installation sites. It was once proposed that the upper rail is designed to be detachable such that the fan mechanism can be withdrawn in a vertical direction. In this arrangement, however, the entire fan mechanism is tilted inwardly in the casing by the weight of the motors of the fan mechanism. As a result, there is a problem that the registration of screw holes for mounting a fan panel to the front plate remarkably lost.

SUMMARY OF THE INVENTION

An object of the present invention is to provide a duct type air conditioner that does not cause the above-mentioned problem by providing a mechanism for the controlled descent of the fan mechanism.

In order to achieve the above object, according to a first embodiment of the invention, there is provided a duct type air conditioner including: a casing having discharge openings and a suction opening therein; said casing being composed of a front plate formed with a discharge duct mounting frame outwardly thereof so as to surround the discharge openings; a fan mechanism mounted inwardly of said front plate; said casing being further composed of a back plate formed with a suction duct mounting frame outwardly thereof so as to surround said suction opening; and a heat exchanger mounted inwardly of said back plate. The fan mechanism includes fan units having fan panels, motors mounted inwardly of said fan panels, and fans positioned inwardly of the fan panels and driven by the motors. A pair of L-shaped vertical rails is mounted on both sides of each of the discharge openings inwardly of the front plate so that the inner portions thereof face each other, and panel retainers are attached inwardly to the lower portions of the discharge openings. Press portions are formed at upper portions of both sides of the fan panels. Both edges of each fan panel are inserted into the vertical rails downward from above while being guided by the pair of vertical rails, the lower edge of the fan panel rides on the panel retainer, and the press portions of the fan panel are pushed down into the vertical rails, so that the fan panel is pressed against the inside of the front plate.

According to a second embodiment of the invention, in the duct type air conditioner according to the first embodiment of the invention, the press portions are formed by bending upper portions of the both edges of the fan panels inwardly.

According to a third embodiment of the invention, in the duct type air conditioner according to the first or second embodiment of the invention, each of the panel retainers includes an inclined surface portion opening inwardly and a stopper portion having a shape to form a bottom. When the both edges of each fan panel are inserted into the vertical rails downward from above while being guided by the pair of vertical rails, the lower edge of the fan panel is guided downwardly and fitted into the stopper portion down the inclined surface portion of the panel retainer.

According to a fourth embodiment of the invention, in the duct type air conditioner according to any one of the first to third embodiments of the invention, a handle portion, which is bent inward, is formed at an upper end of each of the fan panels.

According to a fifth embodiment of the invention, in the duct type air conditioner according to any one of the first to fourth embodiments of the invention, the discharge openings are substituted by the suction opening, the suction opening is substituted by the discharge openings, the discharge duct mounting frame is substituted by the suction duct mounting frame, and the suction duct mounting frame is substituted by the discharge duct mounting frame.

According to the embodiments of the invention, when lower edges of fan panels are inserted until coming into contact with panel retainers while the fan panels are guided by vertical rails from the upper side of the vertical rails mounted on both sides of a front plate and pressing pieces of the fan panels are then inserted into the vertical rails, fan units as a fan mechanism are completely mounted on the inside of the front plate. Accordingly, it is easy to mount the fan units on the inside of the front plate. Further, since the fan panel is mounted at a regular position while being pressed against the inside of the front plate, screw holes of the front plate naturally correspond to screw holes of the fan panels. As a result, it is easy to insert and tighten screws.

DETAILED DESCRIPTION OF THE EMBODIMENTS

Figure 1:
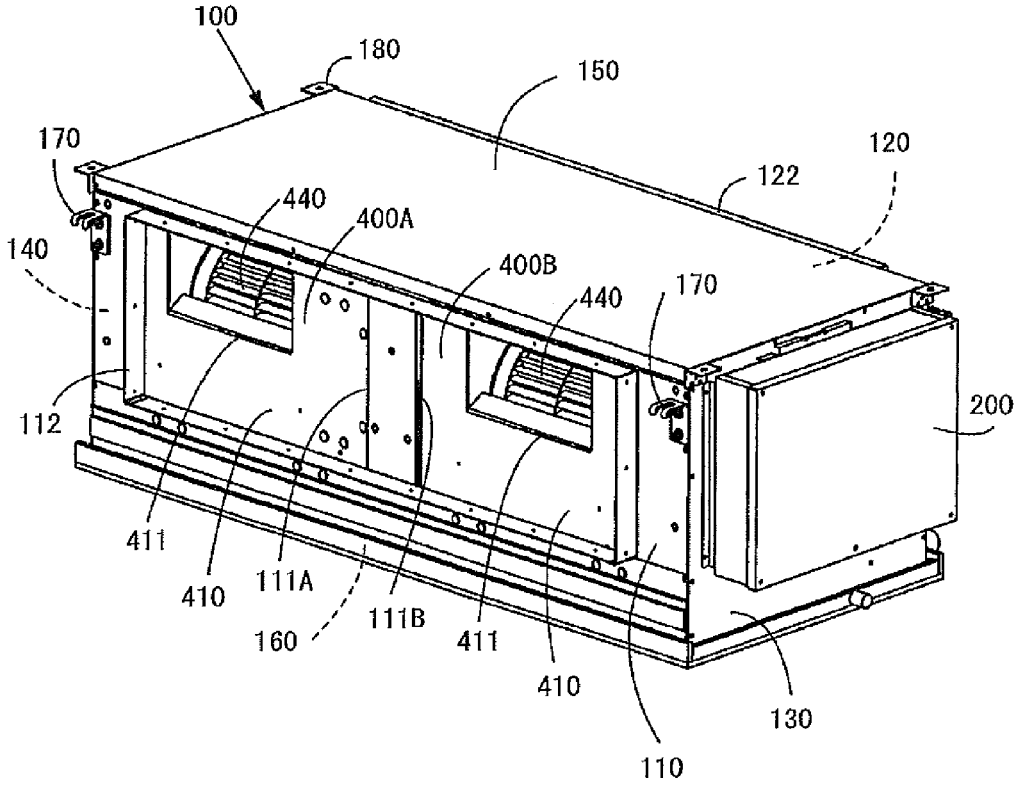
FIG. 1 is a perspective view of a duct type air conditioner according to an embodiment of the invention.

In FIG. 1, a casing 100 includes a front plate 110, a back plate 120, a right side plate 130 to mount an electric component box 200 thereonto, a left side plate 140, a top plate 150, and a bottom plate 160.

Figure 5:
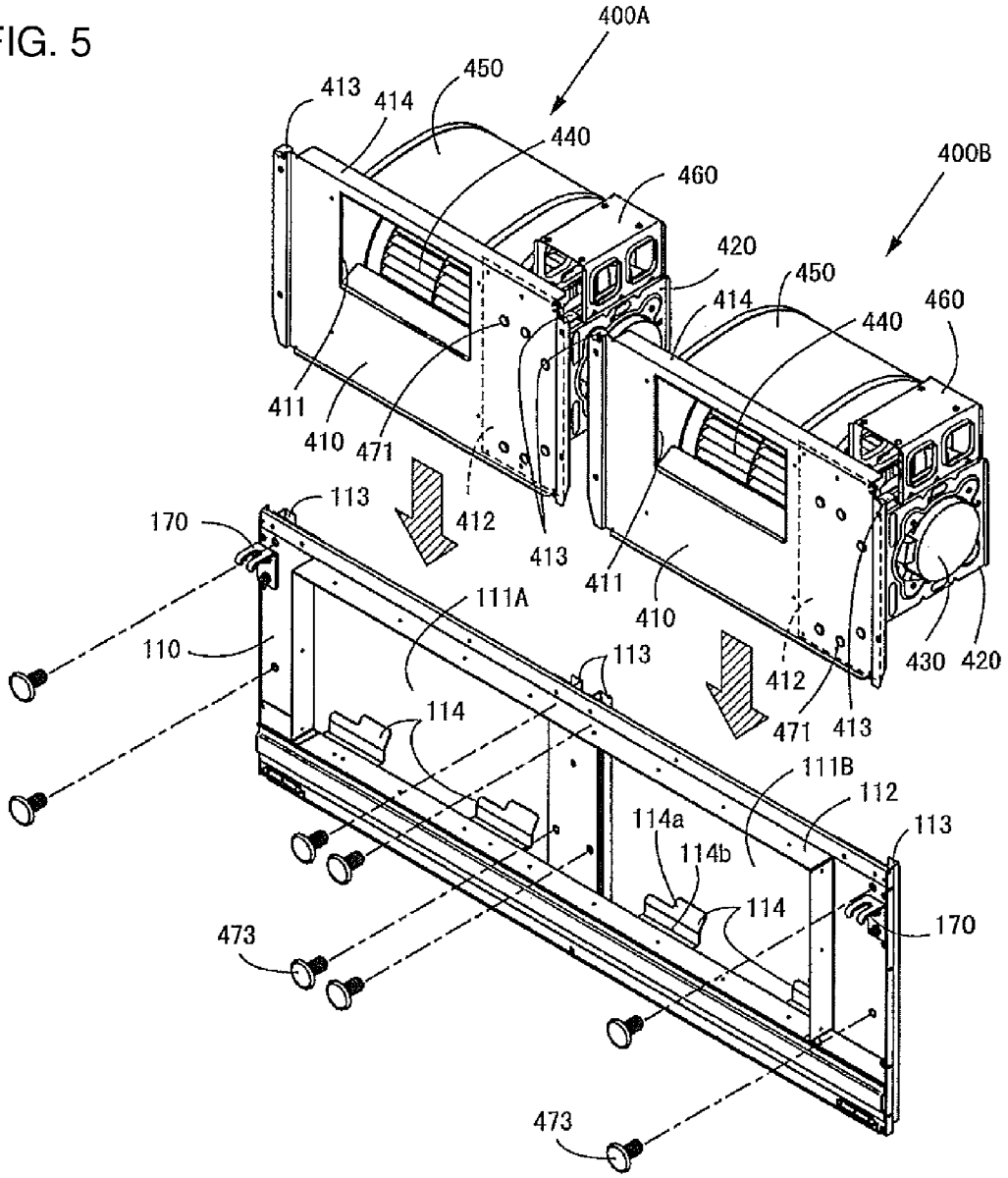
FIG. 5 is an exploded perspective view showing that the fan units are assembled with a front plate of the duct type air conditioner.

For example, as shown in FIG. 5, a discharge duct mounting frame 112 is mounted to the front plate 110 so as to integrally surround discharge openings 111A and 111B arranged so as to be spaced away from each other in a transverse direction. Hanging hooks 170 are attached to the front surface of the front plate 110 at both ends of the upper portion thereof. Further, a pair of vertical rails 113, which is bent in an L shape so that the inner portions thereof face each other, are provided on both sides of each of the discharge openings 111A and 111B inwardly of the front plate. Furthermore, panel retainers 114 are attached inwardly to the lower end of portions of each of the discharge openings 111A and 111B. Each of the panel retainers 114 includes an inclined surface portion 114*a* that is slightly opened inwardly and a stopper portion 114*b* that has the shape of a frame to form a bottom.

Figure 3:
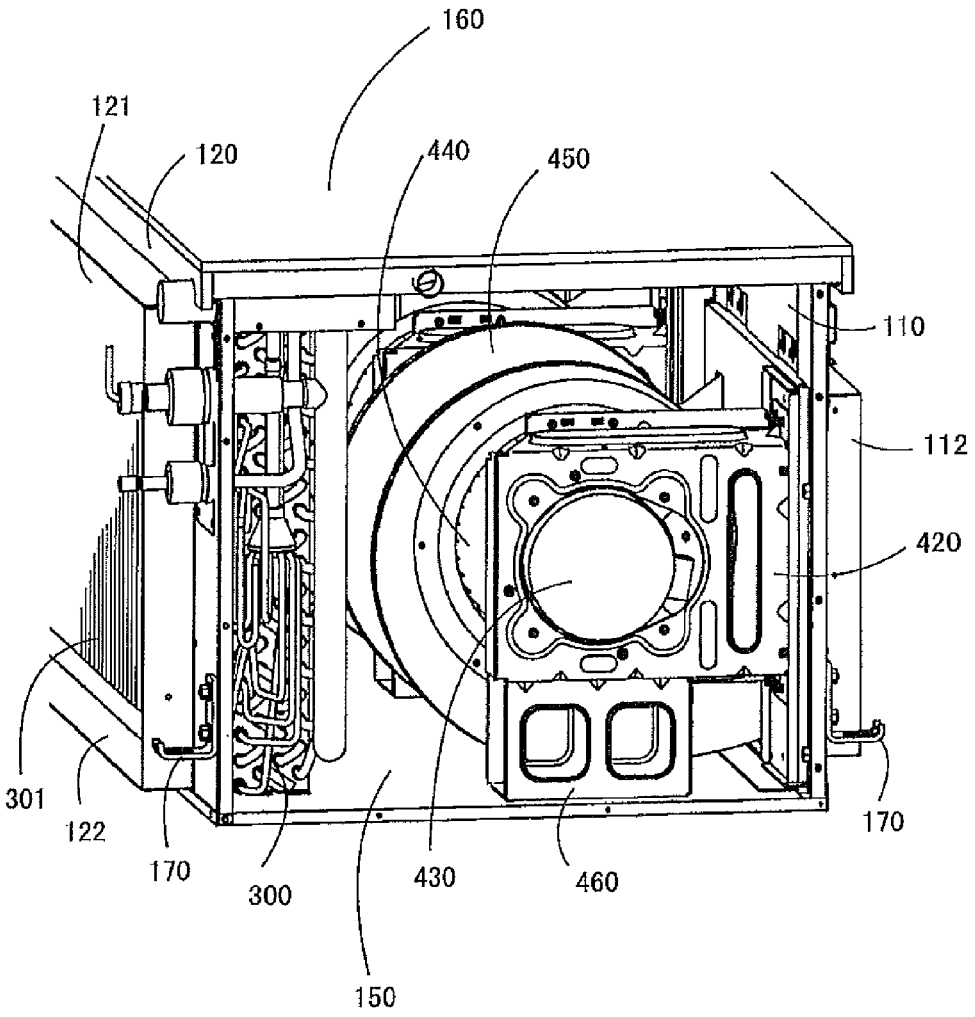
FIG. 3 is a partial perspective view of the duct type air conditioner from which a right side plate and an electric component box are removed and which is turned upside down.

For example, as shown in FIG. 3 showing the duct type air conditioner turned upside down, a suction duct mounting frame 122 is attached to the back plate 120 so as to surround a suction opening 121 through which a fin portion 301 of a heat exchanger 300 is exposed. Further, hanging hooks 170 are attached to the back plate 120 at both ends of the upper portion thereof (the lower portion in FIG. 3 showing the duct type air conditioner that is turned upside down).

Fan units 400A and 400B have the same structure and are independent of each other to form a fan mechanism. For example, as shown in FIGS. 2 to 5, each of the fan units 400A and 400B includes a fan panel 410, a motor support 420 mounted to the back surface of the fan panel 410, a DC motor 430 assembled with the motor support 420, a fan 440 that uses an output shaft of the DC motor 430 as a rotating shaft, a fan cover 450 that surrounds the fan 440 at portions other than where air is sucked and discharged, and a spacer 460 that is mounted on the motor support 420 to serve during the assembling and transport.

In the prior art, a partition plate is used for two fans 410 directly fixed thereto while in the present invention such two separate fan panels (divided fan panel) instead of the single partition plate are used for the separate fans. Each of the fan panels 410 includes a discharge port 411 formed at a position facing the fan 440, a reinforcing plate 412 attached to the inside of the fan panel beside the discharge port 411 in the transverse direction, press portions 413 bent inwardly from upper portions of both side ends of the fan panel 410, and a handle portion 414 as a handle bent inwardly of an upper end portion of the fan panel except for both side ends of the upper end portion. The discharge ports 411 have a size small enough to be positioned in the range of the discharge openings 111A and 111B of the front plate 110. The reinforcing plate 412 is to reinforce a portion of the corresponding fan panel 410, and the motor support 420 is attached to said reinforcing plate 412.

Figure 6:
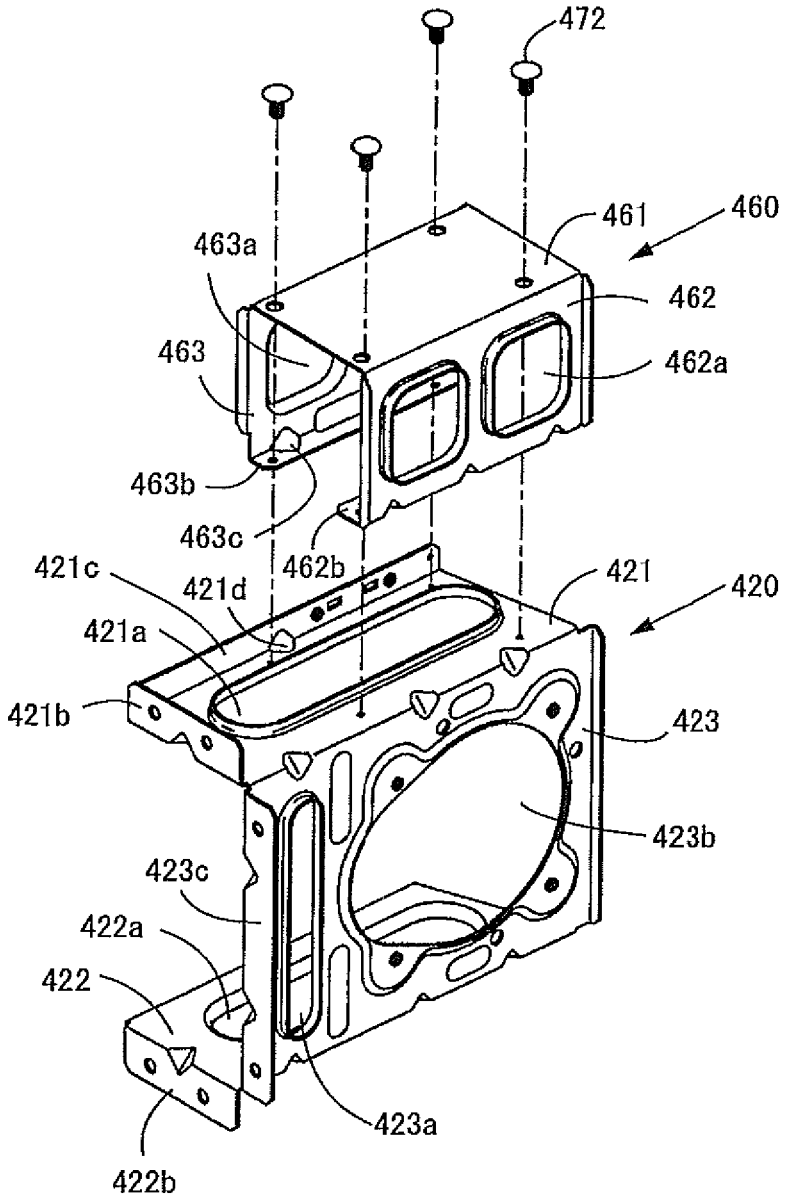
FIG. 6 is an exploded perspective view showing that a spacer is assembled with a motor supporting frame of the duct type air conditioner.

As shown in FIG. 6, the motor support 420 is formed by bending a metal plate into a U shape. The motor support includes a spacer mounting surface 421 on which the spacer 460 is mounted, a bottom portion 422, and a side portion 423. Air holes 421*a*, 422*a*, and 423*a* are formed respectively in the spacer mounting surface 421, the bottom portion 422, and the side portion 423 so as not to interrupt airflow generated by the fan 440. A mounting hole 423*b*, in order to mount the motor 430 therethrough, is formed in the side portion 423. In addition, mounting portions 421*b*, 422*b*, and 423*c*, which are to be fixed to the fan panel 410, are formed by bending common end portions of the spacer mounting surface 421, the bottom portion 422, and the side portion 423 outward. Further, reinforcing ribs are formed by bending the ends of the spacer mounting surface 421, the bottom portion 422, and the side portion 423 as well as the peripheries of the air holes. Furthermore, a substantially triangular pyramid-shaped protrusion 421*d* for positioning the spacer 460 is formed at the bent portion of the reinforcing rib 421*c* of the spacer mounting surface 421.

In order to mount the motor support 420 to the inside of the fan panel 410, the mounting portions 421*b*, 422*b*, and 423*c* are fixed on the reinforcing plate 412, which has already been attached to the inside of the fan panel 410 by screws 471. Accordingly, the motor support 420 is mounted on the inside of the fan panel 410 so as to protrude inwardly. When the motor 430 is mounted on the motor support 420, a large deformation load is applied to the fan panel 410. However, since the thickness of the portion of the fan panel 410 supporting the motor doubles with the reinforcing plate 412, the fan panel can sufficiently bear the load.

The fan cover 450 is attached to the inside of the fan panel 410 by screws (not shown) so as not to interfere with the fan 440. A similar discharge port is formed in the fan cover 450 at a position corresponding to the discharge port 411 of the fan panel 410.

As shown in FIG. 6, the spacer 460 is formed by bending a metal plate into a U shape, and includes a top portion 461 and side portions 462 and 463 such that when the top plate 150 is mounted thereonto, the top portion 461 comes into abutment with said top plate. Air holes 462*a* and 463*a* are formed in both side portions 462 and 463 of the spacer 460 so as not to interrupt airflow generated by the fan 440. Further, mounting portions 462*b* and 463*b*, which are to be fixed to the spacer mounting surface 421 of the motor support 420, are formed by bending the lower ends of the both side portions 462 and 463 inwardly. Furthermore, a substantially triangular hole 463*c* is formed in the bent portion of the mounting portion 463*b* of the side portion 463 to give the spacer 460 the proper positions when the spacer 460 is to be mounted to the motor support 420.

In order to mount the spacer 460 to the motor support 420, the spacer and the motor support are completely positioned by fitting the protrusion 421*d* for positioning the spacer mounting surface 421 of the motor support 420 into the hole 463*c* for positioning the spacer 460. Then, as shown in FIG. 6, the mounting portions 462*b* and 463*b* of the spacer 460 are fixed to the spacer mounting surface 421 of the motor support 420 by screws 472.

As shown in FIG. 5, after being separately assembled in advance, the respective fan units 400A and 400B are mounted inwardly of the front plate 110 by manually holding the handle portion 414 of the fan panels 410 and lowering said respective fan units from above so that the both edges of the fan panels are guided by the vertical rails 113 formed inwardly of the front plate 110 to face each other.

Figure 2:
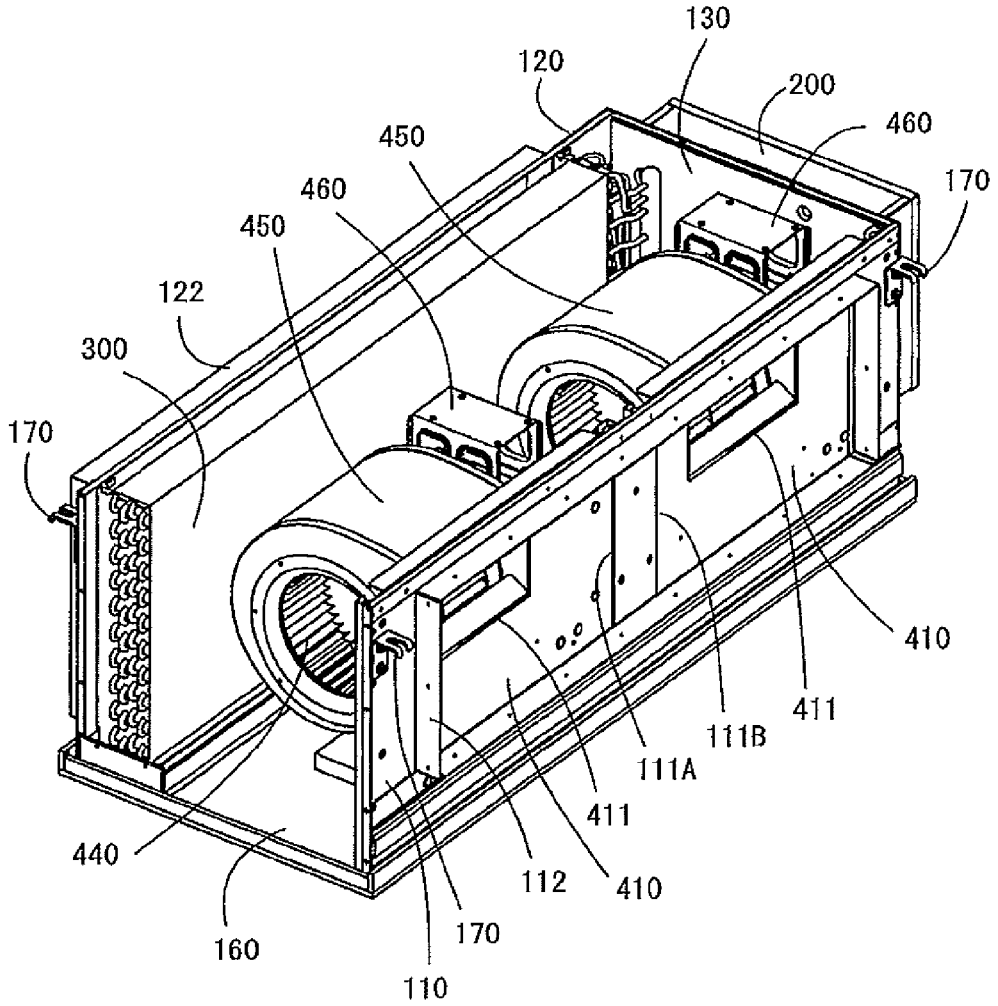
FIG. 2 is a perspective view of the duct type air conditioner from which a top plate and a left side plate are removed.
Figure 7:
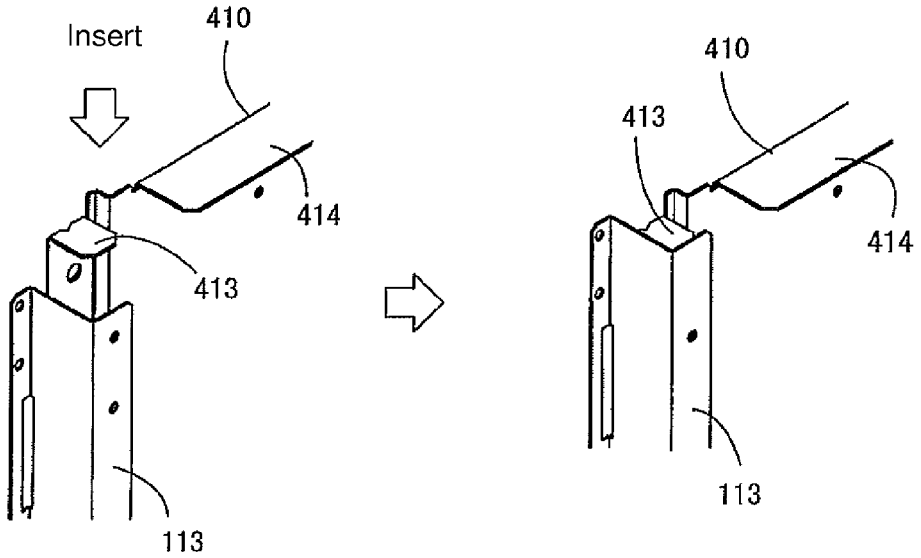
FIG. 7 is a view illustrating a mechanism for maintaining the posture of a fan panel of the duct type air conditioner.

In this case, the lower edge of each fan panel 410 rides the inclined surface portion 114*a* of the panel retainer 114 and slides forwardly while being guided downwardly to fit into the stopper portion 114*b*. Further, as shown in FIG. 7, the press portions 413, which are formed at both sides of the upper end of the fan panel 410, are pushed down into the vertical rails 113 such that the entire fan panel 410 is pressed against the front plate 110 provided forwardly thereof. Further, each of the fan panels 410 is fixed to the front plate 110 inwardly thereof by screws 473 such that the fan units 400A and 400B are assembled with the front plate 110. Therefore, as shown in FIGS. 1 and 2, the discharge ports 411 of the fan units 400A and 400B and the fans 440, which are provided in the casing, are exposed to the outside through the discharge openings 111A and 111B.

As described above, the fan mechanism requiring relatively heavy motors and formed of the fan units 400A and 400B that have the same structure are provided on two divided fan panels, respectively. Accordingly, the entire fan mechanism is downsized in comparison with a fan unit having the same air discharge performance with one motor and two fans, and the total weight of each of the fan units may thus be reduced by half. As a result, it is easier to handle and assemble the fan units. Further, a required die may be downsized such that initial investment can also be reduced. Furthermore, at the time of repair, the screws 473 used for a broken fan unit of the fan units 400A and 400B are removed and only a broken fan unit may be separated from the front plate 110 by manually holding the handle portion 414 with fingers to lift the broken fan unit. After the repair, it is also easy to perform a maintenance service.

In addition, when the lower edges of the fan panels 410 of the fan units 400A and 400B are inserted until coming into contact with the panel retainers 114 while the fan panels are guided by the vertical rails 113 from the upper side thereof formed on both sides of the front plate 110 and the press portion 413 of the fan panels 410 are then pushed down into the vertical rails 113, the fan units 400A and 400B are completely mounted on the inside of the front plate 110. Accordingly, it is easier to mount the fan units 400A and 400B on the inside of the front plate 110. Further, since the fan panel 410 is mounted at a regular position while being pressed against the inside of the front plate 110, screw holes of the front plate 110 naturally correspond to screw holes of the fan panels 410. As a result, screw insertion and tightening work is facilitated.

Figure 4:
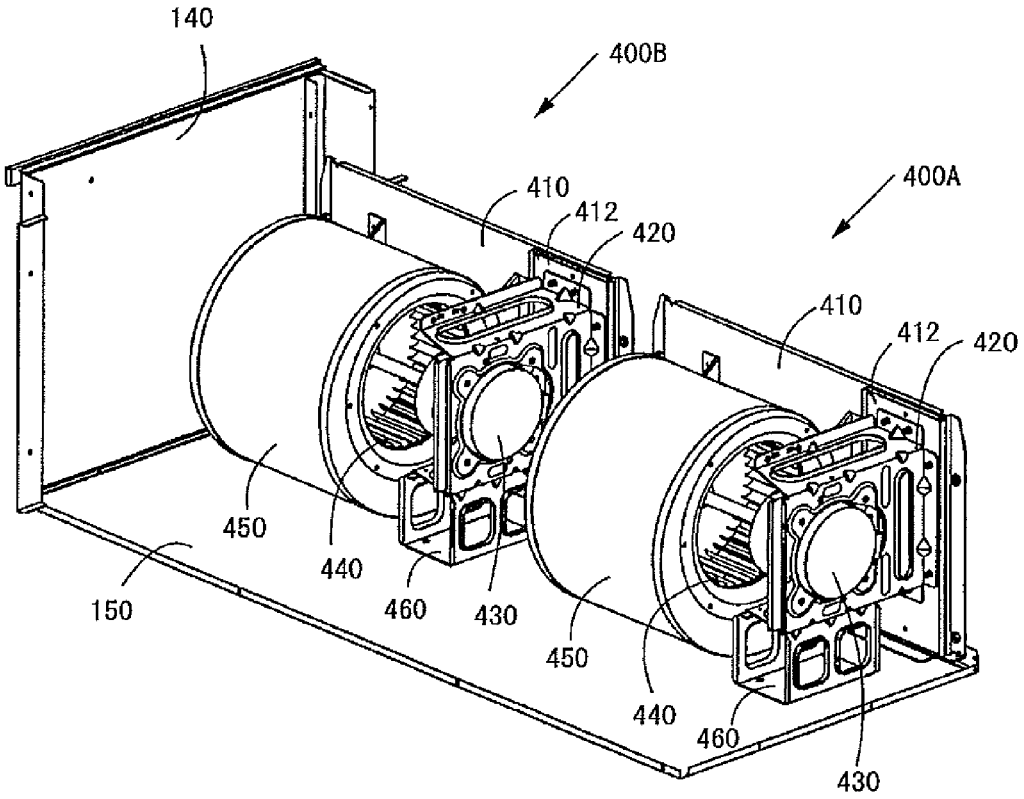
FIG. 4 is a perspective view of fan units provided in the duct type air conditioner and turned upside down.

Further, there are times when the duct type air conditioner is needed to be turned upside down at the time of assembling or conveyance after completion of the assembling operation. If, however, a drop accident occurs due to a certain cause when the duct type air conditioner is turned upside down, large impact loads are applied to the fan panels 410 by the weight of the motors 430 of the fan units 400A and 400B. In such a case, there is a risk of the motor supports or the fan panels 410 being deformed to cause deviation to occur in the shafts of the motors 430 and the fans 440. In this embodiment, since the spacers 460 are mounted on the spacer mounting surfaces 421 of the motor supports 420, the spacers 460 are interposed between the top plate 150 and the motor supports 420 as shown in FIG. 4. Accordingly, the spacers 460 and the top plate 150 bear the impact loads. As a result, it may be possible to prevent the motor supports or the fan panels 410 from being deformed and to prevent deviation in the shafts of the motors 430 and the fans 440.

Meanwhile, in the case the bottom plate 160 is to maintain the lower position by serving as a bottom even at the time of conveyance as at the time of installation, the motor and the fan are likewise completely protected even in a drop accident the spacer 460 is mounted on the surface of the motor support 420 facing the bottom plate 160 because the spacer 460 supports the motor support 420 against the bottom plate 160.

Further, in the above-mentioned embodiments, the heat exchange of the air sucked from the back plate 120 has been performed by the heat exchanger 300 through the operation of the fan units 400A and 400B and the air has then been discharged out of the front plate 110. However, the heat exchange of the air sucked from the front plate 110 may be performed by the heat exchanger 300 through the operation of the fan units 400A and 400B and the air may then be discharged out of the back plate 120. In this case, the discharge openings 111A and 111B serve as the suction opening 121 and the suction opening 121 serves as the discharge openings. Further, the discharge duct mounting frame 112 serves as the suction duct mounting frame, and the suction duct mounting frame 122 serves as the discharge duct mounting frame.

What is claimed is:

1. A duct type air conditioner comprising at least: a casing having discharge openings and a suction opening therein; said casing being composed of a front plate formed with a discharge duct mounting frame outwardly thereof so as to surround the discharge openings; a fan mechanism mounted inwardly of said front plate; said casing being further composed of a back plate formed with a suction duct mounting frame outwardly thereof so as to surround said suction opening; and a heat exchanger mounted inwardly of said back plate, wherein said fan mechanism includes a plurality of fan units each having a fan panel, a motor mounted on the fan panel, a pair of press portions integrally formed with the fan panel on top of the fan panel with bent top two corners of each fan panel orthogonally towards a side on which the motor is mounted, and a discharge port formed on the fan panel, a pair of L-shaped vertical rails is mounted on the front plate on a side the fan mechanism is mounted and at both sides of each of the discharge openings, two panel retainers are attached on the front plate and located on bottom of each of the discharge openings and in between the pair of L-shaped vertical rails, said two panel retainers are separated from each other, each of the panel retainers comprises: a surface portion inclined relative to the front plate to guide the fan panel; and a stopper portion integrally formed with the surface portion and forming a bottom of each panel retainer to fit the fan panel, and each of the plurality of fan units is mounted on the front plate of the casing by inserting a pair of side edges of the fan panel into the pair of L-shaped vertical rails of the front plate respectively and by pressing the pair of press portions of the fan panel downwardly until the fan panel abuts the stopper portion of the panel retainers and until each press portion is completely pressed into a space surrounded by the L-shaped vertical rail and the front plate, so that the fan panel is pressed against the front plate and each discharge port faces each of the discharge openings.

2. The duct type air conditioner according to claim 1, wherein each of the panel retainers comprises an inclined surface portion opening inwardly and a stopper portion having a shape of a frame to form a bottom for guiding and fitting a lower edge of the fan panel.

3. The duct type air conditioner according to claim 1, wherein a handle portion, which is bent inwardly, is formed at an upper end of each of the fan panels.

4. The duct type air conditioner according to claim 1, wherein the air flow is reversed through the air conditioner such that the discharge openings serves as the suction opening, the suction opening serves as the discharge openings, the discharge duct mounting frame serves as the suction duct mounting frame, and the suction duct mounting frame serves as the discharge duct mounting frame.

5. The duct type air conditioner according to claim 2, wherein a handle portion, which is bent inwardly, is formed at an upper end of each of the fan panels.

6. The duct type air conditioner according to claim 2, wherein the air flow is reversed through the air conditioner such that the discharge openings serves as the suction opening, the suction opening serves as the discharge openings, the discharge duct mounting frame serves as the suction duct mounting frame, and the suction duct mounting frame serves as the discharge duct mounting frame.

7. The duct type air conditioner according to claim 3, wherein the air flow is reversed through the air conditioner such that the discharge openings serves as the suction opening, the suction opening serves as the discharge openings, the discharge duct mounting frame serves as the suction duct mounting frame, and the suction duct mounting frame serves as the discharge duct mounting frame.

8. The duct type air conditioner according to claim 5, wherein the air flow is reversed through the air conditioner such that the discharge openings serves as the suction opening, the suction opening serves as the discharge openings, the discharge duct mounting frame serves as the suction duct mounting frame, and the suction duct mounting frame serves as the discharge duct mounting frame.

9. The duct type air conditioner according to claim 1, wherein the fan units comprises: motor supports mounted inwardly of said fan panels; and spacers mounted to said motor supports.

10. The duct type air conditioner according to claim 1, wherein the fan units comprises: reinforcing plates mounted inwardly of said fan panels; and motor supports mounted to said reinforcing plates.

* * * * *